United States Patent [19]

Phillips, Jr. et al.

[11] 3,951,220

[45] Apr. 20, 1976

[54] ARCHIMEDES SPIRAL DRILL BIT

[75] Inventors: Edwin Leslie Phillips, Jr.; James David Carrigan, both of Odessa, Tex.

[73] Assignee: Vance Industries, Inc., Odessa, Tex.

[22] Filed: Aug. 19, 1974

[21] Appl. No.: 498,747

[52] U.S. Cl. ..... 175/393; 175/398; 175/404; 175/410

[51] Int. Cl.[2] ..... E21B 9/16; E21B 9/36

[58] Field of Search ..... 175/329, 330, 404, 405, 175/400, 393, 60, 398, 410; 17/329, 330, 393

[56] References Cited

UNITED STATES PATENTS

| | | | |
|---|---|---|---|
| 2,264,617 | 12/1941 | Carpenter et al. | 175/329 |
| 2,838,284 | 6/1958 | Austin | 175/400 |
| 3,095,935 | 7/1963 | Hildebrandt et al. | 175/330 |
| 3,158,216 | 11/1964 | Baron et al. | 175/410 X |
| 3,583,504 | 6/1971 | Aalund | 175/410 |
| 3,845,830 | 11/1974 | Fowler et al. | 175/404 |
| R26,669 | 9/1969 | Henderson | 175/330 |

*Primary Examiner*—Frank L. Abbott
*Assistant Examiner*—Richard E. Favreau
*Attorney, Agent, or Firm*—Marcus L. Bates

[57] ABSTRACT

A drill bit for use in concentrically arranged dual drill strings. The bit has an outlet eccentrically arranged respective to its longitudinal axial centerline, and a formation engaging surface made of a plurality of spiraling faces which diminish in area as the cutting face curves about and toward the outlet. The area located between the spiraling faces form fluid conveying passageways through which a jet of fluid is directed toward the outlet, thereby carrying therewith cuttings formed by the spiral faces of the bit.

17 Claims, 9 Drawing Figures

ARCHIMEDES SPIRAL DRILL BIT

BACKGROUND OF THE INVENTION

Cone-type drill bits have been successfully employed in forming boreholes into the ground. Cone-type bits are especially useful in air drilling operations, where the borehole extends through frozen formations, as for example, the perma-frost found in the Artic region. Sometimes it is beneficial to vibrate the cone-type bit as it is rotated, thereby enhancing the drilling action.

Cone-type bits of the prior art sometimes lose their efficiency because the formation engaging surface of the bit becomes clogged with debris, and at other times oversized cuttings tend to obstruct the outlet passageway leading from the bit.

Accordingly, it is desirable to provide a cone-type bit having a formation engaging surface thereon which utilizes the rotary energy imparted into the bit in a more efficient manner. Moreover, it is desirable that such a bit have arranged thereon a cutting face which engages the formation in a manner which precludes oversized cuttings being formed. Furthermore, it is desirable that such a bit be low in cost, easily repaired and maintained, and efficient in operation.

SUMMARY OF THE INVENTION

A drill bit for the use in conjunction with concentrically arranged drill pipe wherein drilling fluid flows to and from the bit carrying therewith cuttings formed by a formation engaging face of the bit.

The formation engaging face of the bit includes a plurality of cone-shaped spirals. The spirals are formed by radially spaced apart lands with each land having opposed side walls which join together to form the free end of the land. Each side of the land has converging edge portions which describe a spiral about the central longitudinal axis of an eccentrically arranged outlet tube. The terminal free end portion of each land is spaced apart from one another and placed in close proximity to the inlet of the outlet tube.

The spaced apart lands form spiral passageways which radiate from and flow connect to one another and to the outlet tube. Drilling fluid flows down the drill string annulus into the bit and along the passageways, carrying therewith formation cuttings into the outlet tube.

In one specific form of the invention, the cutting face is formed by an annular circumferentially extending face having an inside peripheral edge portion which forms the major diameter of a truncated cone, with the minor diameter of the truncated cone being concentrically arranged respective to the longitudinal central axis of the drill bit, and with the apex being eccentrically arranged respective to the central axis of the outlet tube. The spiral passageways formed between the conical cutting face terminate in a flat surface from and parallel to the annular shoulder.

Accordingly, a primary object of this invention is the provision of a cone-type drill bit having a conical cutting face in the form of radially spaced apart spirals which form lands having passageways therebetween with the passageways being connected to a common eccentric outlet.

Another object of the invention is to provide a cone-shaped drill bit having a cutting face in the form of conical radially spaced apart lands which join together at one end and terminate in close proximity to a common outlet.

A further object of this invention is to provide a drill bit for use in a dual pipe string so that drilling fluid pumped down the drill string annulus admixes with and carries cuttings to the surface of the ground.

A still further object of this invention is to provide improvements in rotary and percussion type drill bits of the eccentric conical type.

Another and still further object is the provision of a cone-type drill bit having spiraled lands which join together at one end to form a concentric annular area and which terminate in spaced relation to one another adjacent to an outlet thereof.

These and various other objects and advantages of the invention will become readily apparent to those skilled in the art upon reading the following detailed description and claims and by referring to the accompanying drawings.

The above objects are attained in accordance with the present invention by the provision of a combination of elements fabricated in a manner substantially as described in the above abstract and summary.

DETAILED DESCRIPTION OF THE DRAWINGS

Figure 1:
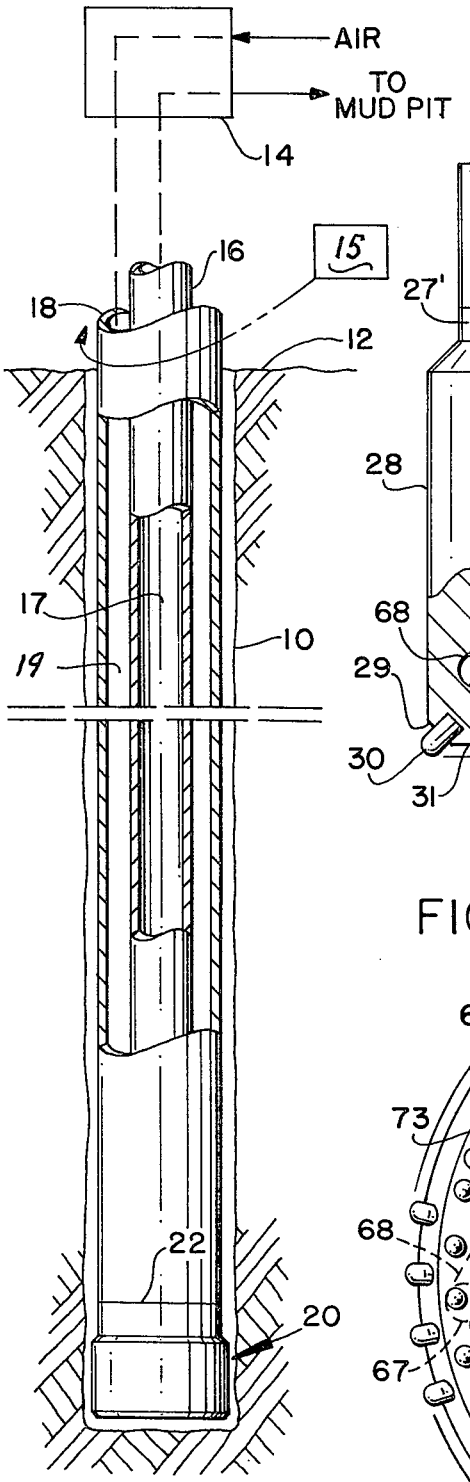
FIG. 1 is a part schematical, part diagramatical, part cross-sectional representation of a borehole-forming operation in which the use of the present invention is illustrated.

In FIG. 1 there is seen a borehole 10 formed within the ground 12 by borehole forming apparatus which includes a rotary drilling rig (not shown) having swivel means 14 associated therewith to enable drilling fluid to be circulated through a concentric dual drill string. The drill string includes an inner tubing 16 forming a return inside passageway 17 for flow of cuttings and fluid to a mud pit. An outer drill pipe 18 forms an annulus 19 so that flow to and from a bit 20 occurs in counter-current relationship. This flow path is sometimes referred to as "reverse circulation", and is also known as "Walker Neers' Concore Process", the details of which are known to those skilled in the art.

The bit 20 is made in accordance with the present invention and is affixed to the terminal ends of the concentrically arranged drill string.

As seen in the figures of the drawings, the bit 20 has a shoulder 22 which reduces into an upper threaded end 24 for engagement with the drill string. The pin end 26 of the upper body again enlarges at 27 to form a lower bit portion 28, which reduces in diameter at 29, thereby leaving an annular conical or sloped annular face having carbide buttons 30 emplanted therein. The lower face 31 of the bit circumferentially extends 360° thereabout in parallel relationship to an inwardly located face 32. The illustrated circumferentially extending spaced apart parallel faces 33 and 33' join the two parallel faces 31 and 32 to one another.

Figure 2:
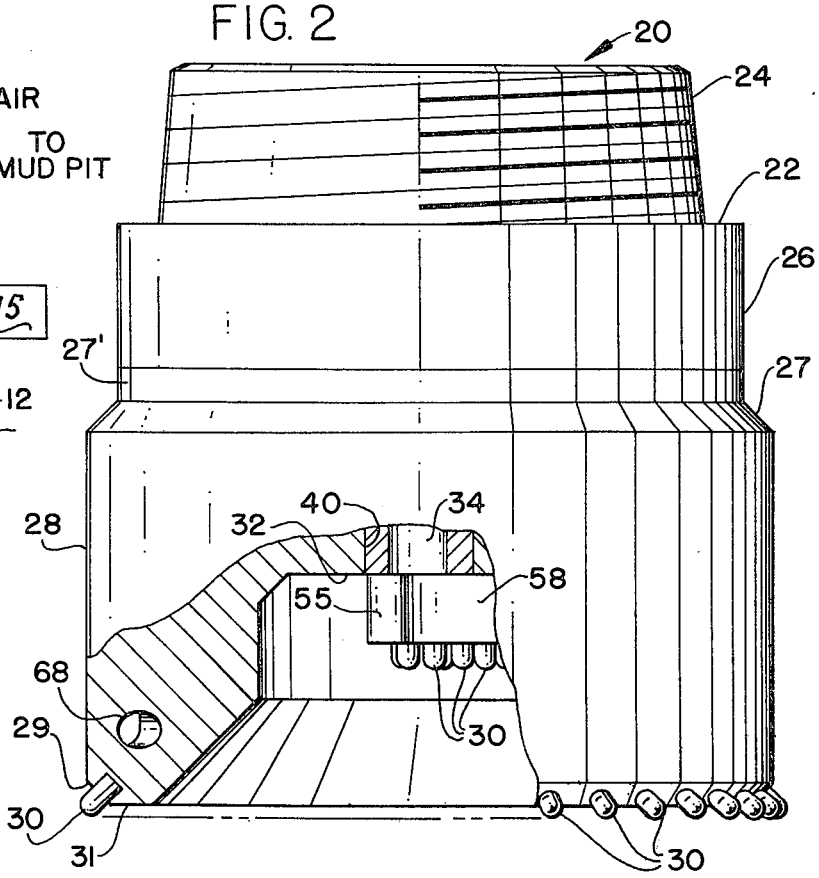
FIG. 2 is an enlarged, side elevational, part cross-sectional view of a drill bit made in accordance with the present invention.
Figure 3:
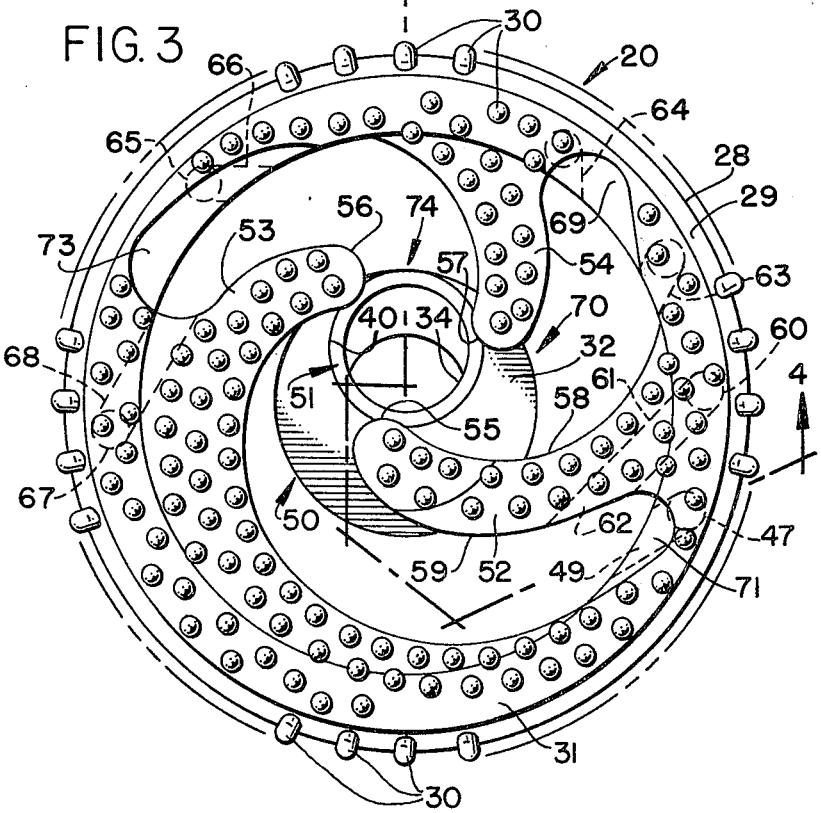
FIg. 3 is a bottom view of the drill bit seen illustrated in FIG. 2.
Figure 4:
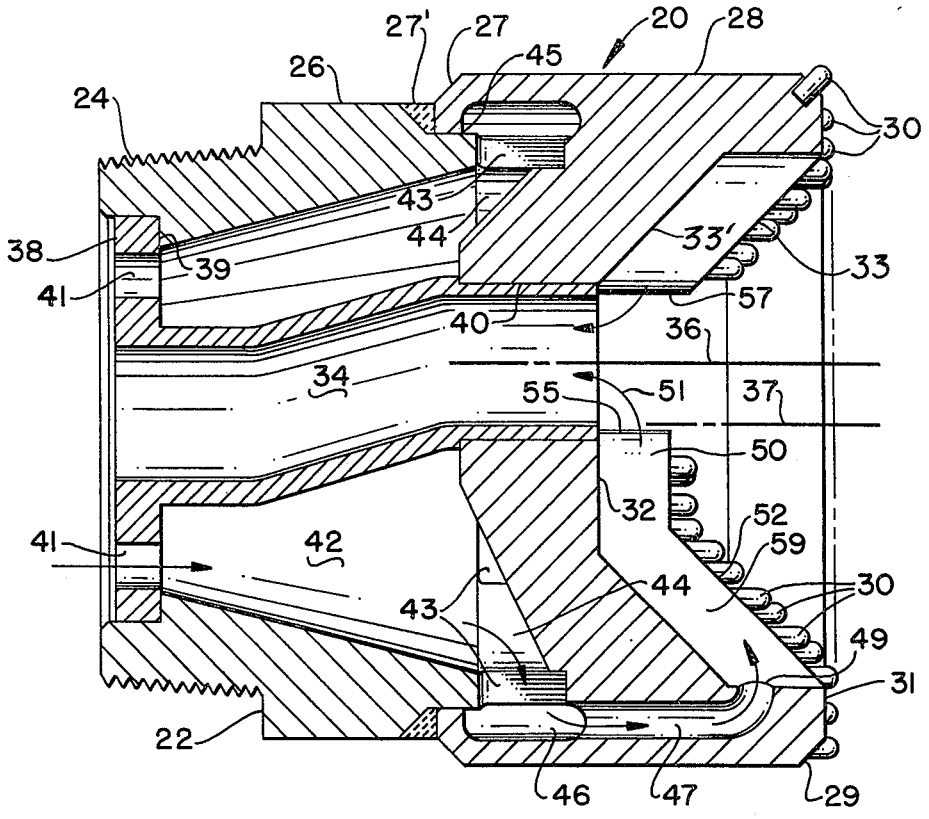
FIG. 4 is a longitudinal, cross-sectional view taken along line 4—4 of FIG. 3, with some additional details thereof being included to enhance the teaching value thereof.
Figure 6:
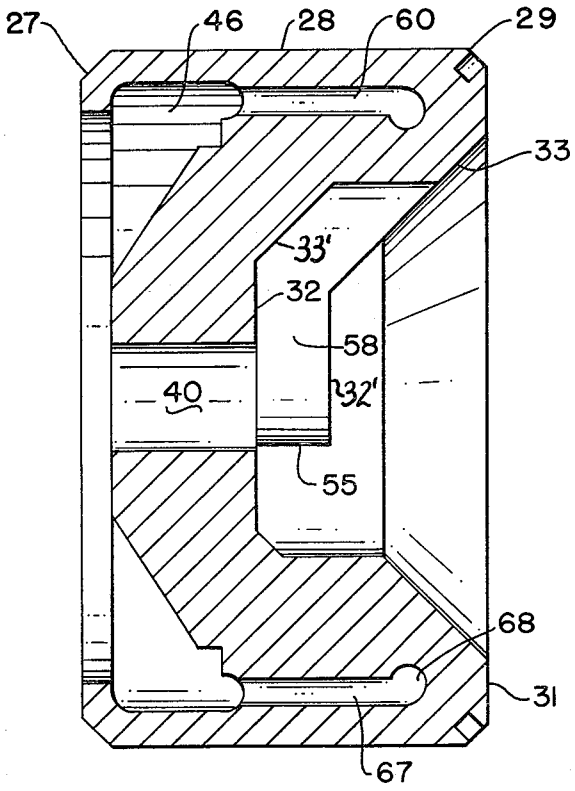
FIG. 6 is a cross-sectional view of a drill bit of this invention, taken along line 6—6 of FIG. 5.

The faces 31 and 33 of the bit in FIGS. 2, 3, and 4 are provided with spiral cutouts for flow of air therethrough in accordance with the teachings of the remaining figures of the drawings. The lands, that is, the formation engaging face which form surfaces 33, are provided with earth commuting or formation engaging digging teeth, such as the illustrated tungsten carbide buttons 30. The buttons preferably are located on 10° centers and are arranged on the lands in the particular illustrated spiral configuration so that any part of the formation is engaged by a button during one rotation of the bit.

An inner tubing connector 34 has the lowermost inlet end portion thereof eccentrically located respective to the central longitudinal axis of the bit in a manner as indicated by numerals 36 and 37.

Figure 5:
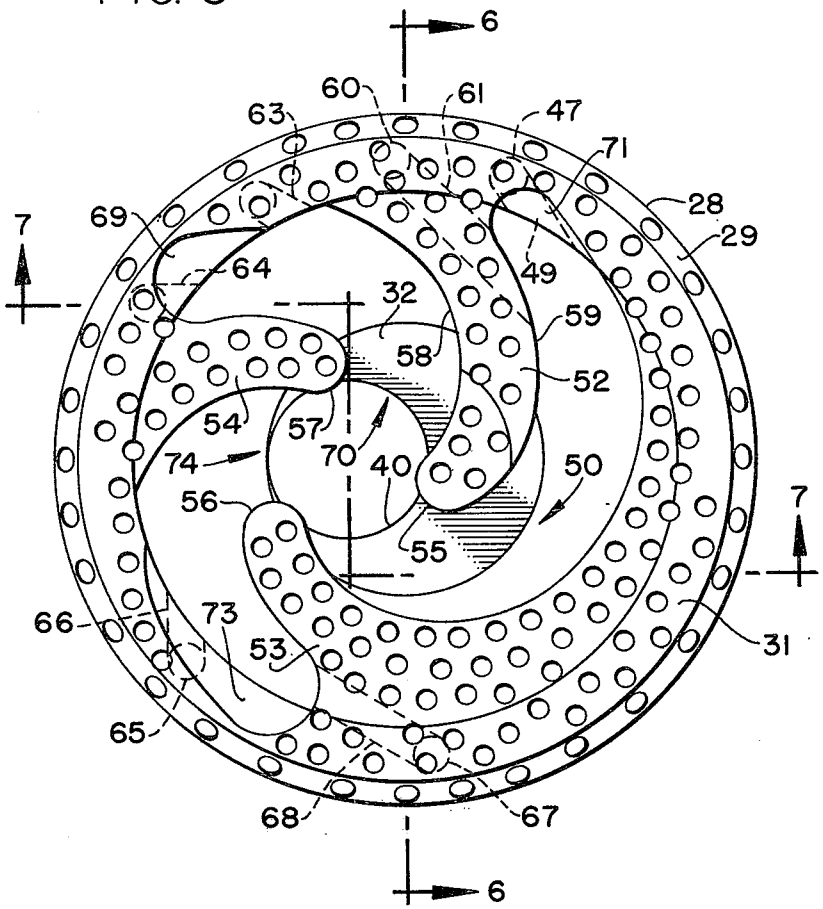
FIG. 5 is a bottom view of a drill bit and is similar to the illustration of FIG. 3.

As seen in the detailed illustration of FIGS. 4 and 5, in conjunction with other figures of the drawing, the pin or upper member 26 is rigidly joined to the drilling or lower member 28 by means of a circumferentially extending weld 27'. The weld can be removed by an engine lathe to enable the drilling member to be separated from the pin member for repair at a subsequent time.

Figure 7:
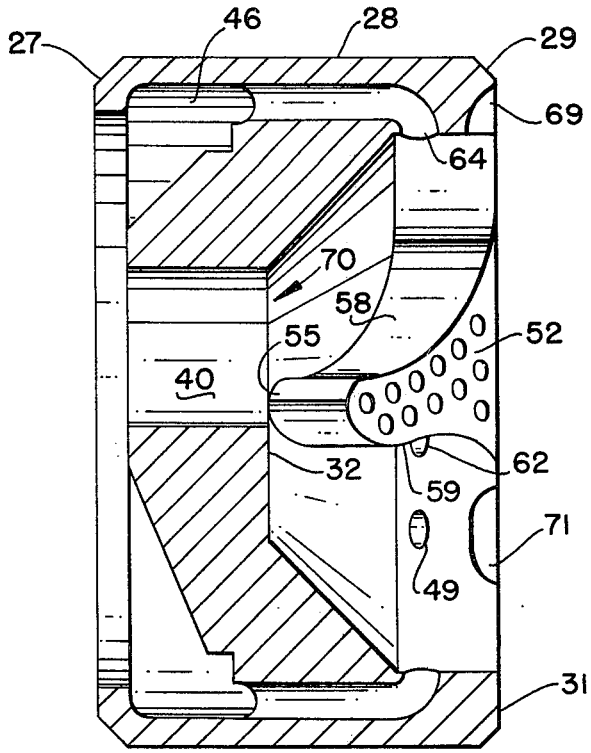
FIG. 7 is more or less a hypothetical, part cross-sectional teaching view of this invention which would almost result if taken along the tortuous path as broadly indicated by the arrows and lines indicated by the numerals 7—7 in FIG. 5.
Figure 9:
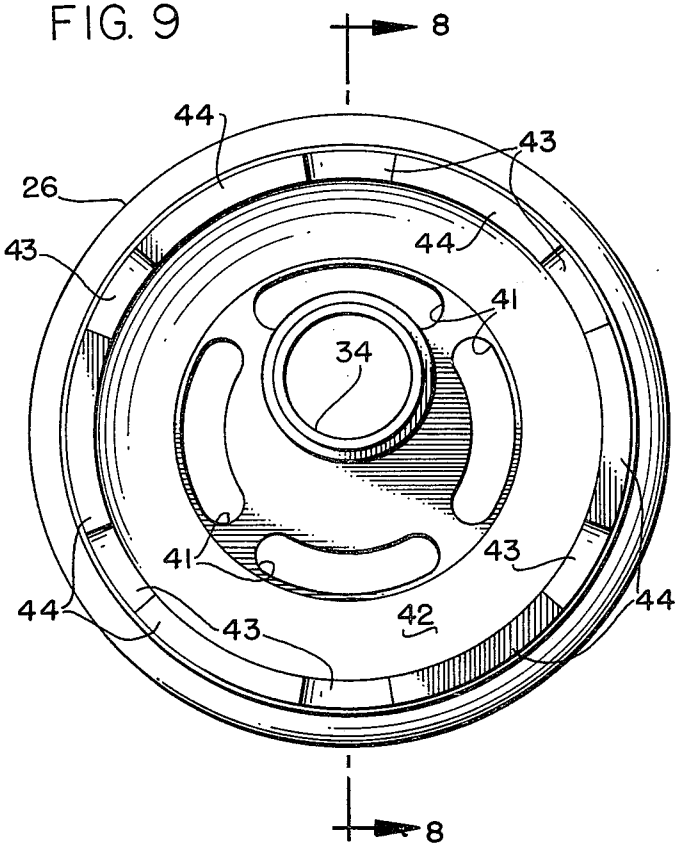
Figure 8:
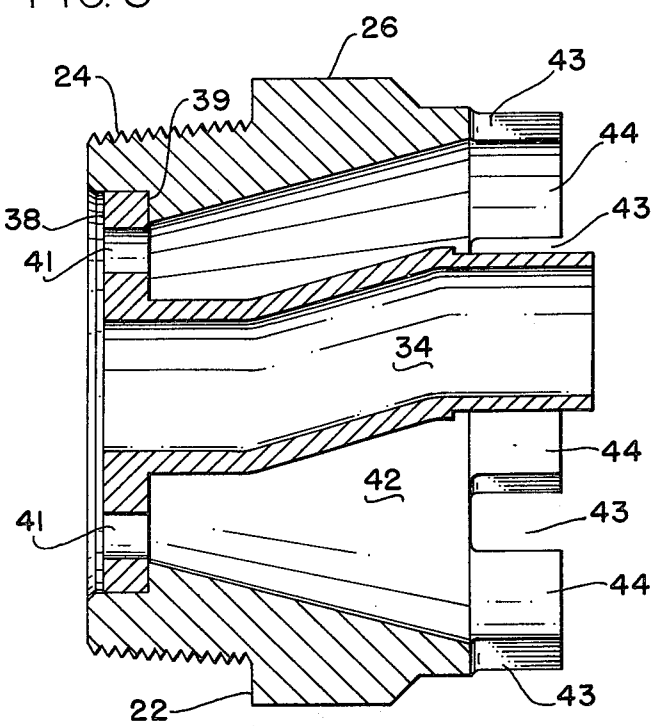
FIG. 8 is a cross-sectional view taken along line 8—8 of FIG. 9; and, FIG. 9 is an end view of the disclosure seen illustrated in FIG. 8.

Central tubing mating connection 38, hereinafter called "connector", is comprised of the illustrated flange member which seats into a complementary groove 39 formed within the pin member. The drilling member is provided with a close tolerance passageway 40 which slidably receives a machined lower marginal end portion of the connector. Radially spaced slots 41 are formed in the connector flange to provide a flow path into an annulus 42. The lower marginal end portion of the pin member is in the form of a circumferentially extending slotted skirt having radially spaced slots 43 formed therein. The lower marginal end portion of the skirt cooperates with the upper marginal end portion of the drilling member as seen at 44 and 45 in FIGS. 4, 7, and 8 to provide a pilot fit so that each member can be perfectly aligned relative to one another for purposes of welding one to the other during assembly thereof. Annular groove 46 is cast into the drilling member to provide a plenum chamber for flow connection to each of a plurality of spiral flow passageways which are formed in the lower portion of the drilling member, as will be better appreciated later on in this disclosure.

Longitudinally extending radially spaced air passageways, one of which is seen at 47 in FIG. 4, has an outlet 49 which laterally directs air at 50 along the spiral cutout formed between faces 32 and 33 so that air moves the cuttings along the spiral passageways of the bit and into the connector as indicated by the arrow at numeral 51 in FIG. 4.

In FIGS. 3 – 8, three lands or formation engaging spirals 52, 53 and 54 are seen to have one end connected together by the annular area 31. The lands are seen to spiral about the longitudinal eccentric axis 36 and toward the return tubing connector. The innermost free terminal ends 55 and 56 and 57 of the spirals terminate in spaced relationship respective to one another and are brought into close superimposed relationship respective to the tubing connector inlet.

Each of the lands, as for example land 52, has opposed sides 58 and 59 made into the form of an Archimedes spiral using the longitudinal eccentric axis 36 of the inner tubing connector as the fixed point about which the spiral is constructed. Lands 53 and 54 have similarly formed walls.

The term "Archimedes Spiral" or "spiral" includes a curve traced in a plane by a point moving about a fixed point while continually approaching or receeding from the plane. Specifically, the term "spiral" as used in the claims is intended to denote a curve 58 or 59 traced about the eccentric axis 36 while moving toward the tubing connector inlet.

The closed end of each spiral passageway is provided with dual spaced air supply conduits arranged 30° respective to one another for conducting flow of chips and debris from the formation, up through the central tubing, and to the surface of the ground.

Vertical air supply passageway 60 connects to the circumferentially extending annular chamber 46 and to a horizontal air passgeway 61, the latter having outlet 62 opening into a spiral passageway. Horizontal passageways 63, 64, 66, and 68 are similarly constructed for communicating the supply annulus with the illustrated horizontally disposed outlets.

As best seen in FIG. 5, the radially spaced lands form a spiral void or passageway therebetween into which cuttings are moved, with one passageway commencing at 69 and opening at 70 into the tubing connector. Another passageway commences at 71 and continues at 50 to where it opens into the tubing connector, while the last passageway commences at 73 and opens at 74 into the inlet of the connector.

DISCUSSION OF THE INVENTION

The drill bit of the present invention preferably is used in the manner of FIg. 1 wherein concentrically arranged drill pipe are employed. The string has an outer drill pipe threaded at each depending end thereof to permit connections to be effected therebetween in the usual manner. A concentrically located tubing string is concentrically positioned within the outer drill pipe in the illustrated manner of FIG. 1 so that the depending ends thereof sealingly cooperate together to permit rapid connection between the entire assembly to be effected. The concentrically arranged drill pipe permits rapid return of large cuttings to the surface of the earth while at the same time the cone-shaped formation engaging surface of the bit is maintained substantially free of debris, that is, reground cuttings.

The present invention is especially useful in carrying out shallow drill operations, as for example, core samples or boreholes for pilings. It has been found that when rotary motion as well as reciprocatory motion is imparted into the bit, that penetration of most type formations is enhanced.

In the present invention, drilling fluid in the form of air circulates down the drill string to the bit where the air is directed into the plenum chamber, through the passageways 47 or 60, and along the passageways 62 and 71 of FIG. 3, for example. This operation continuously moves solid and liquid masses toward the common outlet and into the connector.

As the drill bit of FIG. 3 rotates with the turn table of the drilling rig revolving in the usual clockwise direction, the tungsten carbide buttons will be rotating counterclockwise as seen in the bottom view of FIG. 3, for example. The arrangement of the buttons 30 on the formation engaging face of the bit is of a spiraled pattern arranged whereby any exposed particle of a formation must be engaged by at least one cutting button during one revolution of rotation.

As the bit rotates, the commuted material will be forced towards the passageways and toward the inlet because of the Archemedes spiral configuration of the lands. The geometrical configuration of the lands and passageways respective to the eccentric outlet and the longitudinal central axis of the bit provides unexpected efficiency in penetrating hard formations.

As seen in FIG. 4, the inner tubing is shown illustrated as an integral part of flange 38, and a separate part respective to the upper member 26 and lower member 28. Those skilled in the art will appreciate that the inner tubing, flange, and upper member can all be cast as an integral part if deemed desirable. It is preferred that the upper and lower members be fabricated as separate parts and subsequently welded together in indexed relationship at 27' so that when it is necessary to replace or rebuild a worn bit, the bit can be placed within a lathe, the weld at 27' removed with a cutting tool, and the entire lower bit section 28 replaced by welding a new member to the old upper member.

The carbide buttons 30 are preferably placed on 10° centers with lines of circumferentially disposed buttons following a spiral in a manner similar to the opposed walls 58 and 59, for example, of the lands.

The spiral cutting face imparts a natural conveying action into individual cuttings as they are loosened from a formation. The present invention is effective in forming boreholes in permafrost. The bit preferably is used in conjunction with a rotary drilling rig having means thereon for vibrating the bit as it turns.

The geometrical configuration of a bit made in accordance with the present invention is difficult to visualize in the absence of first having viewed a model thereof. The bit broadly comprises an annular surface 31 disposed in spaced parallel relationship respective to spaced surfaces 32 and 32'. The conical cutting face 33 is disposed parallel to the conical face 33'. The face 33' is interrupted by the lands, or conversely, the face 33 is interrupted by the spiral passageways. Hence, face 33 is the conical cutting face while face 33' measures the depth of the spiral passageways.

The surfaces 32 and 32' are concentric with respect to the faces 31, 33, 33', yet the spirals are formed about the eccentric axial center line of the connector inlet.

Land 52 has a marginal free end portion which is turned parallel to face 32 because the bit would otherwise be loaded unevenly as it engaged the formation with a cutting action.

I claim:

1. A drill bit for borehole forming operations comprising a main body having a pin end for connection into a drill string, and a bit end having surfaces for engaging a formation;

a connector having a flow passageway therethrough, an inlet for said connector eccentrically arranged respective to the main body; said inlet being spaced from said formation engaging surface;

said formation engaging surface being formed of spaced lands each having a free end portion spaced from one another and terminating in close proximity of said inlet; each land being defined by opposed walls which follow a spiral about the inlet and join together to form said free end portion;

said formation engaging surface having a cone-shaped surface arranged concentrically respective to said main body; and, cutting means on said lands for engaging and cutting a formation.

2. The drill bit of claim 1, wherein the drill string is a concentrically arranged dual pipe string for conveying drilling fluid to the bit and returning cuttings from said flow passageway;

means forming an inlet flow passageway within said main body separate from the first recited flow passageway so that fluid from the dual pipe string annulus can flow to said inlet flow passageway;

and means flow connecting said inlet flow passageway to a location between adjacent lands so that flow occurs between said lands and toward the first said inlet.

3. The drill bit of claim 1, wherein the area between the adjacent lands is in the form of a spiral passageway which is in communication with the first said inlet;

a fluid inlet formed in said main body and opening into said spiral passageway, and means by which said fluid inlet can be connected to a source of drilling fluid so that cuttings formed by the lands are washed through said spiral passageway and into the first recited inlet.

4. The drill bit of claim 1, wherein said main body includes spaced parallel surfaces, one surface forming the marginal end of said bit and forming part of the formation engaging surface, the other parallel surface being concentrically arranged respective to the axial center line of said bit and having said inlet forming therein;

said marginal end of said bit defining the major diameter of said cone.

5. A drill bit having a lower circumferentially extending edge portion spaced from an inner eccentrically arranged inlet tube; means forming an annular flow passageway within the bit;

a plurality of radially spaced lands forming a cone-shaped formation cutting face on said bit, each land having opposed side walls which join together to form the free end of said land, each said side wall having an edge portion which describes a spiral about the central longitudinal axis of the eccentrically arranged inlet tube; each land terminating in a free end portion which is spaced from one another and placed in close proximity to said inlet tube;

spiral passageways formed by said spaced apart lands, said passageways being flow connected to one another and to said inlet tube;

and a flow passageway connecting the annulus to the passageway.

6. The bit of claim 5 wherein said bit has a pin end spaced from said circumferentially extending edge portion for connection to the outermost one of concentrically arranged dual drill pipe;

means by which one end of said inlet tube can be connected to the central one of the dual drill pipe;

means by which said annulus can be flow connected to the drill string annulus so that drilling fluid can flow down the drill string annulus, into the first said annulus, through said spiral passageways, into said inlet tube, and up the central one of the dual drill pipe and to the surface of the ground.

7. The bit of claim 5 wherein said cone-shaped portion of said radially spaced lands is disposed between spaced parallel surfaces, each being concentrically arranged respective to one another and to the longitudinally extending central axis of the bit;

one parallel surface defining the lower terminal end of the bit, the other parallel surface defining the upper terminal end of the uppermost cutting face of the bit.

8. A drill bit for use in a concentrically arranged dual drill string wherein the string is arranged to provide concentric passageways for countercurrent flow to and from the bit;

said bit having a connector, said connector having one end arranged for connection into the innermost pipe of the dual string, said connector having an inlet end eccentrically arranged respective to the axial centerline of the bit;

a formation engaging conical face formed within said bit, spiral cutouts formed within said conical face, said cutouts forming a plurality of spiraling cutting faces which diminish in area as the cutting face spirals about and towards said inlet end of said conector;

said cutouts forming fluid conveying passageways through which fluid is directed towards said inlet end of said connector, thereby carrying therewith cuttings formed by the spiral faces of the bit.

9. The drill bit of claim 8 wherein said formation engaging face further includes spaced parallel faces, the spaced faces defining the major and minor diameters of a truncated cone, the conical face of the truncated cone being the aforesaid formation engaging conical face.

10. The drill bit of claim 8 wherein said spiraling faces terminate in spaced relation respective to one another and respective to said inlet end of said connector.

11. The drill bit of claim 8 wherein said cutouts have a closed end spaced from a common outlet end portion with said common outlet end portion being flow connected to said inlet end of said connector;

a plenum chamber formed within said bit, means by which said chamber can be connected to one countercurrent flow path of a concentric dual pipe string; and means forming a flow path from said plenum chamber into said closed end portion of said cutout.

12. The drill bit of claim 8 wherein said formation engaging face further includes spaced parallel faces, the spaced faces defining the major and minor diameters of a truncated cone, the conical face of the truncated cone being said formation engaging conical face; and, said spiraling faces terminate in spaced relation respective to one another and to said inlet end of said outlet.

13. The bit of claim 8 wherein said cutouts form spaced sides which define said spiraling faces, each said side spiraling towards and about said inlet, each said side of a face joining one another to thereby form a free end portion, each face having a free end portion spaced from the free end portion of another face.

14. The drill bit of claim 8 wherein said formation engaging face further includes spaced parallel faces, the spaced faces defining a major and a minor diameter of a truncated cone, the conical face formed by the truncated cone being the before recited formation engaging conical face;

said cutouts each have a common outlet end, a closed end which is spaced from said common outlet end with said common outlet end being flow connected to said inlet of said connector;

a plenum chamber formed within said bit, means by which said chamber can be connected to one countercurrent flow path of a concentric dual pipe string; and means forming a flow path from said plenum chamber through said closed end portion of said cutout, and along the passageway formed between the spaced spiral cutting faces.

15. The bit of claim 14, wherein said spiraling faces terminate in spaced relation respective to one another and to said inlet end of said connector.

16. A rotary drill bit for borehole forming operations comprising a main body having an upper end for connection into a drill string, and a lower bit end having a formation engaging surface formed thereon for engaging and cutting a formation;

said main body having means forming a flow passageway therethrough, means by which one end of said flow passageway is eccentrically arranged respective to the main body; said eccentrically arranged end of said passageway being spaced from said formation engaging surface;

said formation engaging surface being formed of spaced lands, each of said lands having a free end portion spaced from one another with said free end portion terminating in close proximity of said eccentrically arranged end of said passageway; each of said lands being defined by opposite walls, said opposite walls being arranged to follow a spiral path at least part of the way about said eccentrically arranged end of said passageway, said opposite walls being joined together to form said free end portion;

said formation engaging surface including spaced surfaces between which a cone-shaped surface is arranged; one of said spaced surfaces being concentrically arranged respective to said main body;

and cutting means on said formation engaging surface for engaging and cutting a formation.

17. A drill bit for borehole forming operations comprising a main body having a pin end for connection into a drill string, and a bit end having surfaces formed thereon for engaging and cutting a formation;

means forming a flow passageway through said main body; said flow passageway having an end thereof which is eccentrically arranged respective to the main body;

said formation engaging surface being formed of spaced lands, each having a free end portion spaced from one another and terminating in close proximity of said inlet; each land being defined by opposite walls which describe a spiral at least part of the way about said passageway and join together to form said free end portion;

said formation engaging surface having a cone-shaped surface arranged concentrically respective to said main body; said end of said passageway being spaced from said cone-shaped formation engaging surface; and, cutting means on said lands for engaging and cutting a formation.

* * * * *

UNITED STATES PATENT OFFICE

CERTIFICATE OF CORRECTION

PATENT NO. : 3,951,220

DATED : April 20, 1976

INVENTOR(S) : Edwin Leslie Phillips, Jr. et al

It is certified that error appears in the above-identified patent and that said Letters Patent are hereby corrected as shown below:

Column 6, line 44, correct spelling of "formed".

Column 7, line 35, correct spelling of "connector".

Column 7, line 37, substitute --may be-- for "is".

Signed and Sealed this

Thirty-first Day of August 1976

[SEAL]

*Attest:*

RUTH C. MASON
*Attesting Officer*

C. MARSHALL DANN
*Commissioner of Patents and Trademarks*